United States Patent [19]

Mace

[11] 4,142,257

[45] Mar. 6, 1979

[54] BODY SHOWER

[75] Inventor: Allen R. Mace, Flat 1608, 55 Morehead St., Redfern, Sydney, Australia, 2016

[73] Assignees: Allen Ronald Mace; Isabelle Catholine Mace, both of Redfern, Australia

[21] Appl. No.: 808,816

[22] Filed: Jun. 22, 1977

[30] Foreign Application Priority Data

Jun. 24, 1976 [AU] Australia ..... PC6406

[51] Int. Cl.[2] ..... A47K 3/22

[52] U.S. Cl. ..... 4/152

[58] Field of Search ..... 4/152, 153, 159, 161, 4/145

[56] References Cited

U.S. PATENT DOCUMENTS

| | | | |
|---|---|---|---|
| 18,101 | 9/1857 | Meyer | 4/152 |
| 430,257 | 6/1890 | Taylor | 4/152 |
| 1,426,519 | 8/1922 | Swift | 4/152 |
| 3,971,074 | 7/1976 | Yxfeldt | 4/152 |

*Primary Examiner*—Richard E. Aegerter
*Assistant Examiner*—L. Footland
*Attorney, Agent, or Firm*—Kane, Dalsimer, Kane, Sullivan and Kurucz

[57] ABSTRACT

This invention relates to a body shower assembly arranged to substantially surround the body of a user, thereby defining a showering zone into which water is sprayed, the shower assembly being adapted for vertically slidable movement along the wall of a shower booth, bathroom etc. so that it may be raised or lowered in accordance with the personal requirements of the user.

6 Claims, 4 Drawing Figures

BODY SHOWER

BACKGROUND OF THE INVENTION

1. Field of the Invention

This invention relates to a body shower.

2. Brief Description of the Prior Art

Conventional body showers consist of a shower rose mounted on the outlet of a water pipe fixed at a convenient location in a bathroom or shower booth. The water pipe has connections to hot and cold water lines whereby the temperature of water flowing from the shower rose may be controlled to suit the personal requirements of the user.

Showers of this type spray water over a fairly wide area and if the user stands directly under the shower the whole of the body is wet or at least dampened by the water flowing from the shower rose. Wetting or dampening of the hair on certain occasions may prove inconvenient and has led to the current use of shower caps. The use of shower caps may however prove inconvenient in so far as they can cause disarrangement of the coiffure of the user.

In an attempt to overcome this problem, arrangements have been proposed whereby the shower rose is mounted on a flexible hose which is connected to the hot and cold water outlets in the bathroom or shower booth. The hose is of such length and flexibility that it permits the shower rose to be held in the hand and moved to various locations by the user whereby wetting or dampening of the hair may be avoided. However, this arrangement has the disadvantage that one of the user's hands is at all times occupied in holding the shower rose.

The present invention has been devised to provide a body shower which overcomes the problems of the prior art and which provides a body shower which will not effect wetting or dampening of the head unless so directed by the user.

SUMMARY OF THE INVENTION

According to the present invention there is provided a shower assembly adapted for slidable movement along a wall surface, said shower assembly comprising at least one tubular shower member arranged to define a showering zone and including water inlet means adapted to be connected to a water supply and water outlet means comprising a plurality of spaced apart holes located at intervals in the wall of said tubular member and directed into said showering zone so that, in operation, water entering said inlet means passes through said tubular member and out of said holes into said showering zone.

DETAILED DESCRIPTION OF THE PREFERRED EMBODIMENT OF THE INVENTION

According to a preferred embodiment of the present invention, the shower assembly includes two tubular members disposed in spaced apart relationship and interconnected at regular intervals therealong by a series of longitudinal spacing members. Preferably, the tubular members define a substantially circular showering zone.

The shower assembly also comprises inlet means which preferably includes a flexible hose adapted to be connected to a water supply line. This hose may be adapted to connect to any convenient water outlet such as a wall tap or a shower outlet subsequent to the removal of the shower rose. The inlet means may further include a tap which is operable to redirect the flow of water entering the inlet means to an outlet nozzle so disposed as to permit the monitoring of the water temperature.

A further embodiment of the present invention provides for at least one container to be attached to the shower assembly and a tap associated with the container and operable to permit liquid to flow from the container into the inlet means whereby liquid contents of the container may mix with the water passing through the shower assembly, thus enabling the selective addition of soaps and perfumes to the shower water.

The present invention also provides for the shower assembly to be adapted for slidable movement along a wall surface. Preferably, the shower assembly may be so adapted by means of a pair of longitudinal rail members adapted to be fixedly attached to the wall surface and a plurality of wheels rotatably mounted on the shower assembly and disposed for operative engagement with the rail members, thus allowing the shower assembly to be moved to any one of a variety of desired positions. Locking means may also be provided in order to retain the shower assembly at any desired position along the rail members.

A particular embodiment of the present invention will now be described with reference to the accompanying drawings in which:

Figure 1:
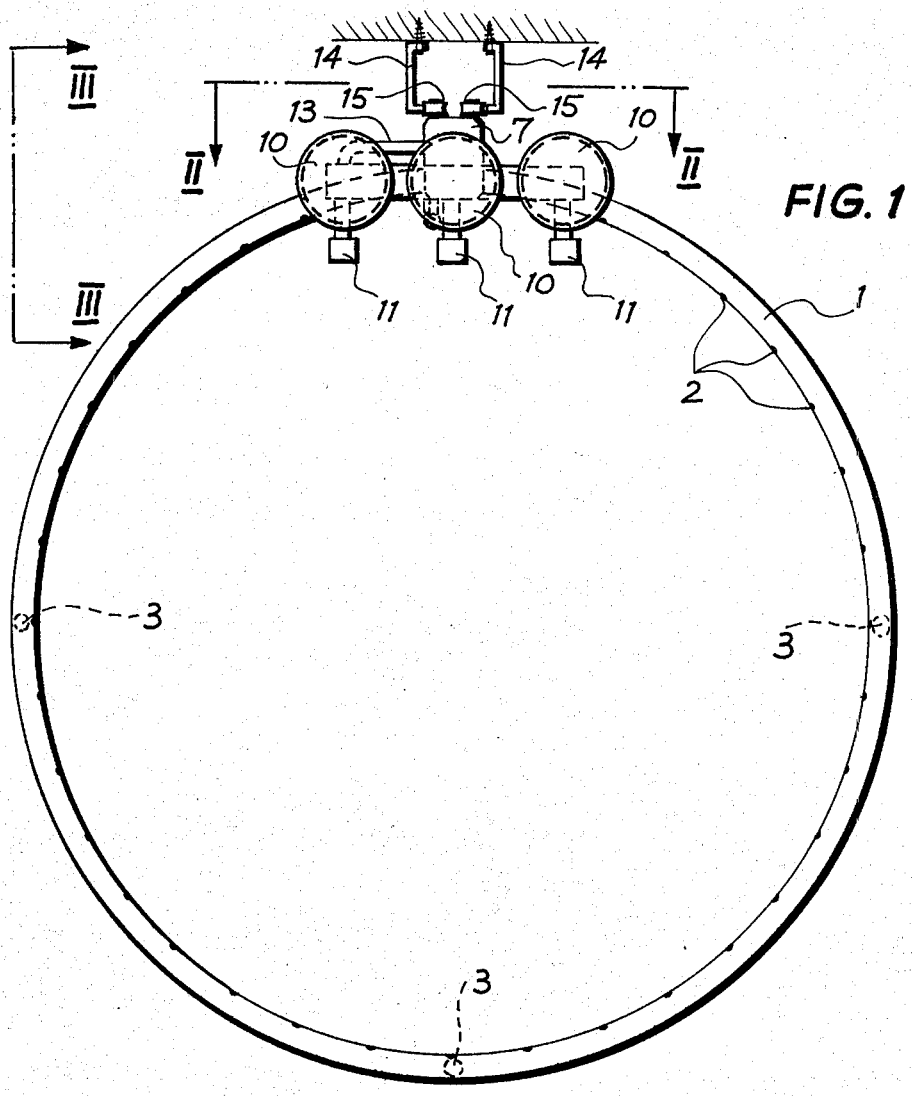
FIG. 1 is a plan view of a shower assembly according to one preferred embodiment of the present invention.
Figure 2:
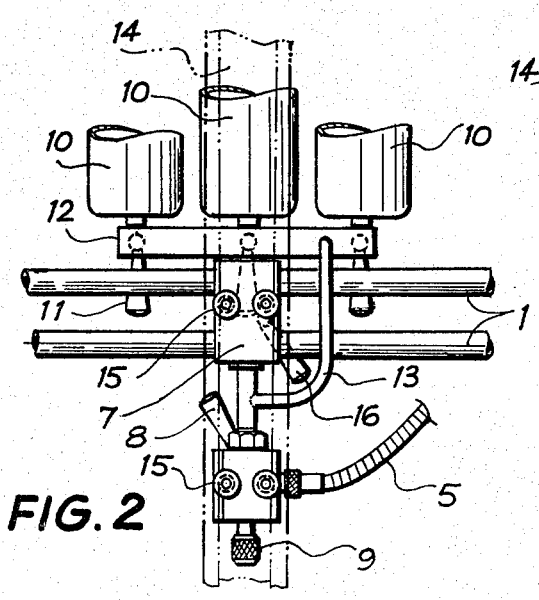
FIG. 2 is a view along the lines II — II of FIG. 1.
Figure 3:
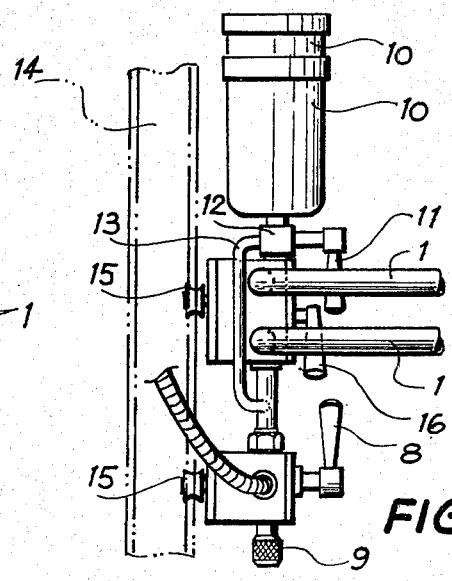
FIG. 3 is a view along the lines III — III of FIG. 1.
Figure 4:
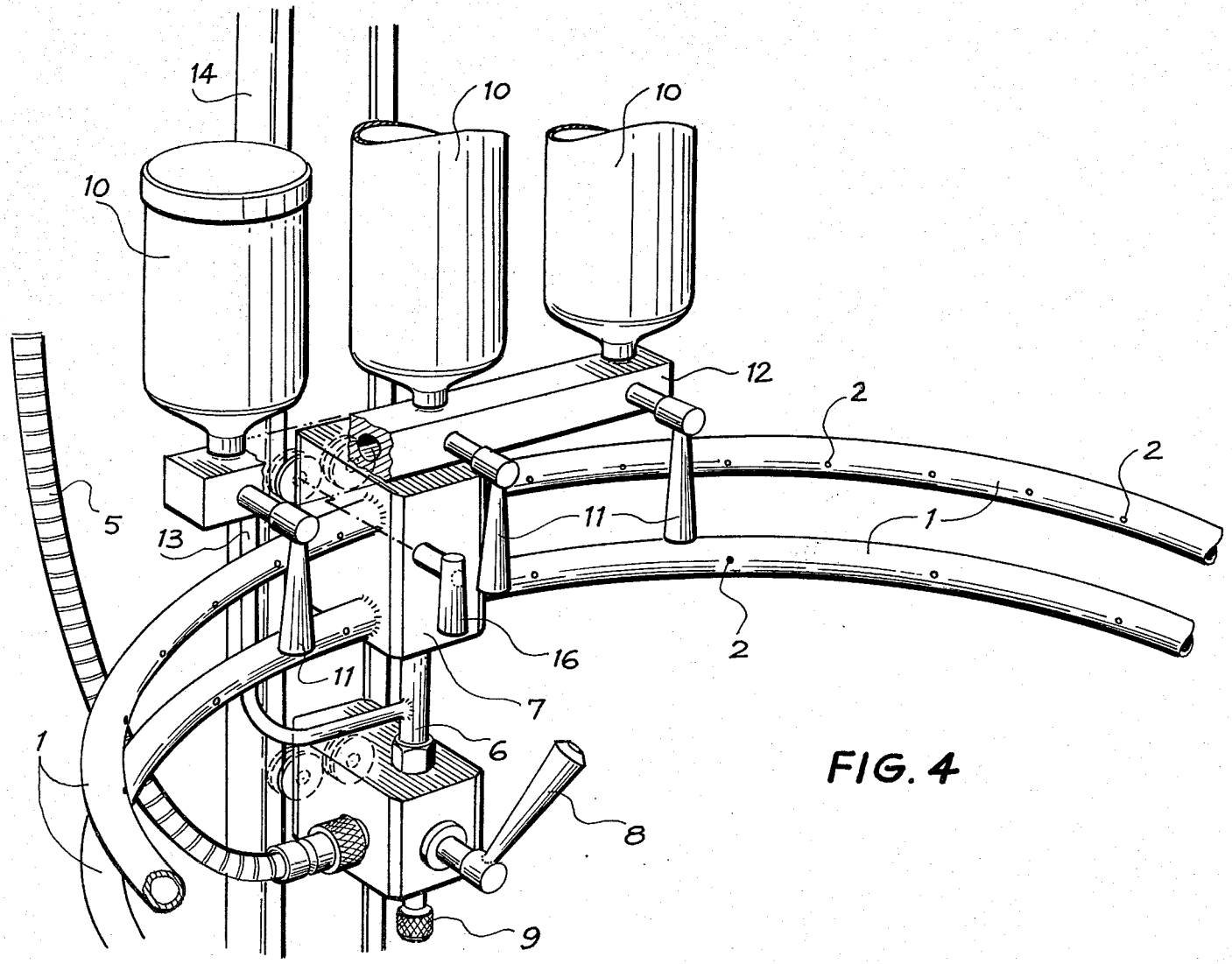
FIG. 4 is a detailed perspective view of the apparatus shown in FIGS. 2 and 3.

Referring generally to the drawings, a shower assembly comprises a pair of tubular members 1 arranged to define a substantially circular showering zone. A plurality of spaced apart holes 2 is provided in the wall of each tubular member 1 and constitutes a water outlet whereby water flowing through the tubular members is directed into the showering zone. The two tubular members 1 are maintained in spaced apart relationship by spacing members 3.

An inlet means 4 is connected to a flexible hose 5 which is adapted to connect at its other end to a convenient water outlet such as a wall tap or a shower outlet (the shower rose having been removed). Water entering the inlet means 4 flows into pipes 6 and junction block 7, whereupon it is directed into each of the two tubular members 1 and into the showering zone through holes 2. A tap 8 is provided with a first position whereby water entering the inlet means 4 is permitted to flow into pipe 6 as aforesaid, and a second position whereby water flowing into inlet means 4 is redirected through nozzle 9. This feature provides for the temperature of the incoming water to be monitored before water is permitted to flow into the showering zone.

Containers 10 are operatively connected via associated valve means 11 into junction block 12. Upon the opening of one of the valve means 11, liquid contained in the respective container 10 is permitted to flow into junction block 12 and through pipe 13 into pipe 6, whereupon it is mixed with the incoming water flowing into junction block 7. This feature provides for the selective addition of soaps and perfumes to the showering water.

The shower assembly is mounted for slidable movement along a wall surface by means of the two rail members 14 which are fixedly attached to the wall surface. A plurality of wheels 15 are rotatably mounted at the rear of the shower assembly and adapted for operative engagement with rail members 14, thereby permitting sliding movement of the shower assembly along the length of the rail members. A clamp means 16 is adapted to effect locking of the shower assembly against movement away from any desired position along the rail members. Preferably, the rail members 14 are disposed in parallel relationship and mounted vertically on the wall surface. The height of the shower assembly may therefore be ajusted to suit the requirements of a particular user.

In operation, the shower assembly is raised to allow a prospective user to enter the area defined as the showering zone. The shower assembly is then lowered to a desired height so as to encompass the body of the user. With the shower assembly set at the appropriate height, showering may be performed without the risk of wetting or dampening of the hair.

We claim:

1. A shower assembly adapted for slidable movement along a wall surface, said shower assembly comprising a tubular shower member encircling a showering zone and including water inlet means adapted to be connected to a water supply and water outlet means comprising a plurality of spaced apart holes located at intervals in the wall of said tubular shower member and directed into said showering zone so that, in operation, water entering said inlet means passes through said tubular shower member and out of said holes into said showering zone, and means for slidably mounting said tubular shower member on the wall surface whereby said member may be raised and lowered in a vertical direction and wherein said mounting means includes a pair of longitudinal rail members adapted to be fixedly attached to said wall surface and a plurality of wheels rotatably mounted on said shower assembly and disposed for operative engagement with said rail members.

2. A shower assembly as claimed in claim 1 including locking means adapted to retain said shower assembly at any desired position along said rail members.

3. A shower assembly as claimed in claim 1 including a second tubular shower member aligned in spaced apart relationship with the first tubular shower member and a common water supply means for both shower members.

4. A shower assembly as claimed in claim 1 wherein said inlet means includes a flexible hose adapted to be connected to a water supply line.

5. A shower assembly as claimed in claim 1 wherein said inlet means includes valve means operable to redirect the flow of water entering said inlet means to an outlet nozzle so disposed as to permit the monitoring of the temperature of the water entering said inlet means.

6. A shower assembly as claimed in claim 1 including at least one container attached to said shower assembly and valve means operable to permit liquid to flow from said container into said inlet means.

* * * * *